US006743053B2

(12) United States Patent
Wu

(10) Patent No.: US 6,743,053 B2
(45) Date of Patent: Jun. 1, 2004

(54) ELECTRICAL CONNECTOR WITH IMPROVED SPACER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/215,777

(22) Filed: Aug. 9, 2002

(65) Prior Publication Data

US 2004/0029428 A1 Feb. 12, 2004

(51) Int. Cl.[7] ..... H01R 24/00
(52) U.S. Cl. ..... 439/634; 439/686; 439/357
(58) Field of Search ..... 439/357, 634, 439/637, 686, 374, 378, 567

(56) References Cited

U.S. PATENT DOCUMENTS 4,173,387 A * 11/1979 Zell ..... 439/557
4,363,530 A * 12/1982 Verhoeven ..... 439/557
4,871,320 A * 10/1989 Mouissie ..... 439/78
4,993,965 A * 2/1991 Eck ..... 439/374
5,030,140 A * 7/1991 Sugiyama ..... 439/607
5,137,462 A * 8/1992 Casey et al. ..... 439/74
5,382,168 A * 1/1995 Azuma et al. ..... 439/65
5,409,404 A * 4/1995 Reed ..... 439/738
5,542,860 A * 8/1996 Bandura et al. ..... 439/567
5,577,936 A * 11/1996 Hahn ..... 439/607
5,609,502 A * 3/1997 Thumma ..... 439/747
5,634,810 A * 6/1997 Niitsu et al. ..... 439/378
5,820,392 A * 10/1998 Lin et al. ..... 439/108
6,077,092 A 6/2000 Chiu et al.
6,135,823 A * 10/2000 Torii ..... 439/686
6,168,478 B1 * 1/2001 Daoud ..... 439/746
6,257,925 B1 * 7/2001 Jones ..... 439/557
6,287,146 B1 9/2001 Avery et al.
6,315,615 B1 * 11/2001 Raistrick ..... 439/637
6,331,122 B1 12/2001 Wu
6,491,536 B1 * 12/2002 Torii ..... 439/246

* cited by examiner

*Primary Examiner*—Hae Moon Hyeon
(74) *Attorney, Agent, or Firm*—Wei Te Chung

(57) ABSTRACT

An electrical connector (1) includes a first insulative housing (10), a number of contacts (20), and a second housing (30) attached to the first housing. The first housing defines a first and a second cavities (101,103) therein, a number of passageways (104) in communication of the cavities. Each contact received in the passageways has a mating portion (25) extending into the cavities, and further includes a solder portion (21) extending away from the first housing. The second housing defines a number of channels (34) for securely receiving the solder portions therethrough. An interengaging device arranges between the first and second housing such that the second housing is secured attached to the first housing.

19 Claims, 6 Drawing Sheets

ELECTRICAL CONNECTOR WITH IMPROVED SPACER

BACKGROUND OF THE INVENTION

1. Field of the Invention

The present invention relates to an electrical connector, and particularly to an electrical connector with an improved spacer for positioning contacts of the connector precisely.

2. Description of Related Art

Computers are widely used in the fields of E-commerce, E-business, Home network, Internet work station and so on. Each computer has a data storage center, e.g. hard disk, where computer software and business data information are saved. When the computer runs, the computer Central Processing Unit (CPU) continuously accesses the hard disk and retrieves data from the hard disk or stores data to the hard disk. For compatibility, the hard disk driver interfaces are standardized. There are many hard disk driver interface standards and the SCSI families and ATA families are the most famous in the last decade. The electrical connector used in hard disk driver must comply with the corresponding interface standards. An organization, called the Serial Advanced Technology Attachment (hereinafter referred to as SATA) Working Group and set up by APT Technologies Inc, Dell Computer Corporation, International Business Machines, Intel Corporation, Maxtor Corporation, Quantum Corporation, and Seagate Technology released a specification to define the SATA interface and the corresponding connectors. The specification defines a first type of SATA connector connecting to a cable and a second type of SATA connector mounting to a printed circuit board (PCB). The second type of SATA connector defined by the specification includes an insulative housing, a plurality of contacts received in the housing and two board locks fixed to the housing for attaching the connector to the PCB. The housing provides a guiding post on each one of two opposite side faces of the housing for guiding the connector to mate with a mating connector.

However, each connector is required a spacer to precisely space tail portions of contacts thereof from each other a predetermined distance in order to correctly ensure soldering such connectors onto the PCB. Moreover the tail portion of the contact has a length which is too long resulting in excessive flexibility thereof. It becomes tedious to correctly extend tail portions having excessive flexibility into contact tail portion receiving holes defined in the spacer. Thus an independent spacer is required to organize the tail portions precisely.

It is thus desirable to provide a spacer constructed as a separate part of an electrical connector with improved retention structure to alleviate or even eliminate the above-discussed problem.

SUMMARY OF THE INVENTION

An object of the present invention is to provide a spacer constructed as a separate part of an electrical connector with improved retention structure.

To obtain the above object, an electrical connector includes a first insulative housing, a number of contacts, and a second housing attached to the first housing. The first housing defines a first and a second cavities therein, a number of passageways in communication of the cavities. Each contact received in the passageways has a mating portion extending into the cavities, and further includes a solder portion extending away from the first housing. The second housing defines a number of channels for securely receiving the solder portions therethrough. The interengaging device arranges between the first and second housing includes a receptacle defined in the guiding post of the first housing and a hook formed on the second housing. The interengaging means further includes a block extending from a middle portion of the first housing and an auxiliary hook on the second housing. When the second housing is attached to the first housing, the hook is securely received in the receptacle of the guiding post in a longitudinal direction and the auxiliary hook to be securely received in a receptacle of the block in a traverse direction such that the second housing is secured attached to the first housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
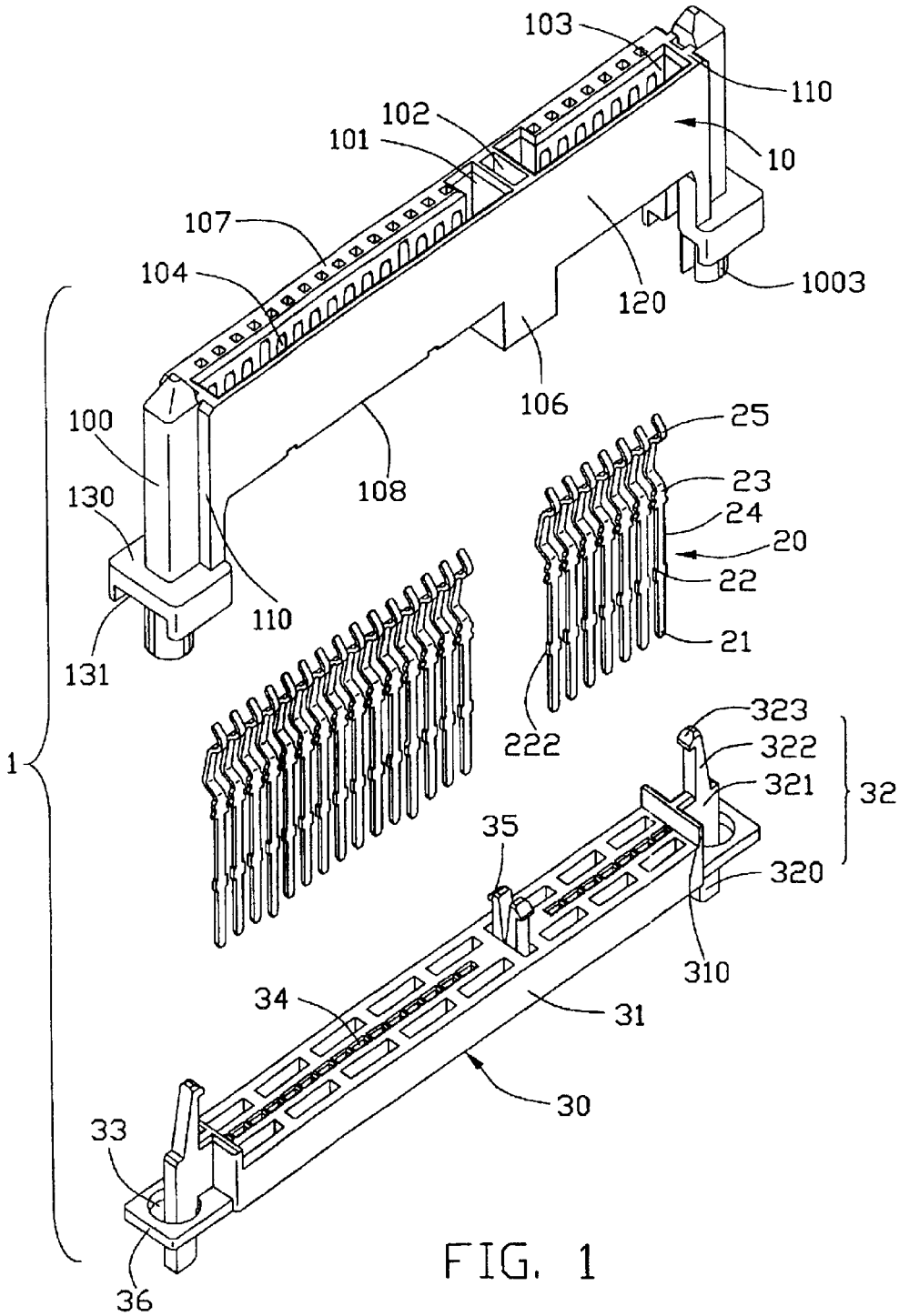
FIG. 1 is an exploded view of an electrical connector with a spacer in accordance with the present invention.
Figure 2:
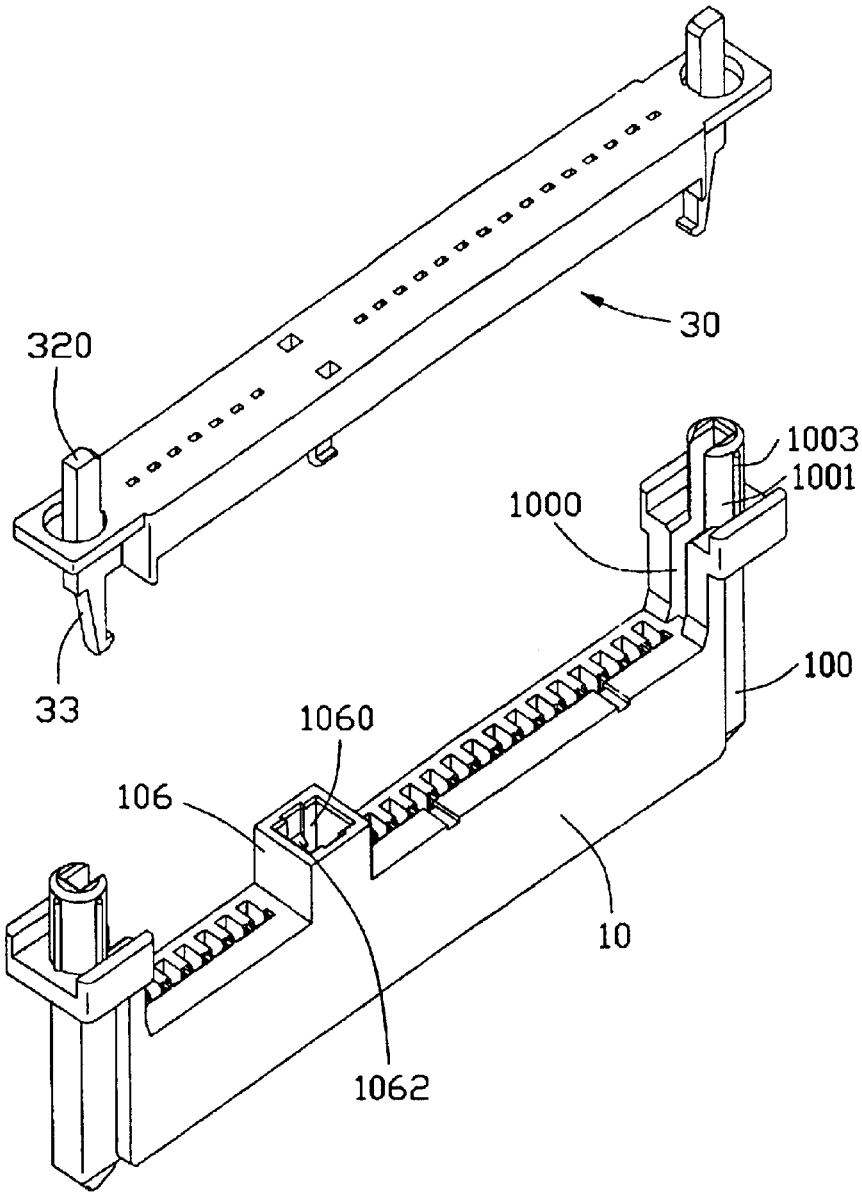
FIG. 2 is a bottom, exploded view of the electrical connector of FIG. 1 with contacts being removed.
Figure 3:
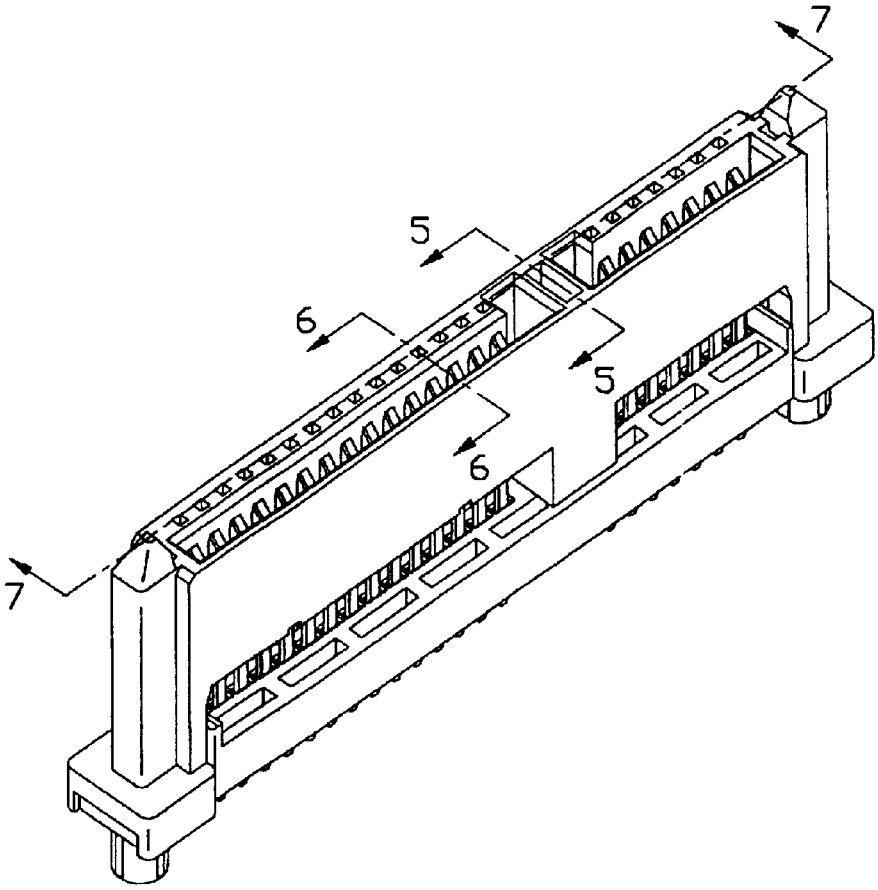
FIG. 3 is assembled perspective view of the electrical connector.
Figure 4:
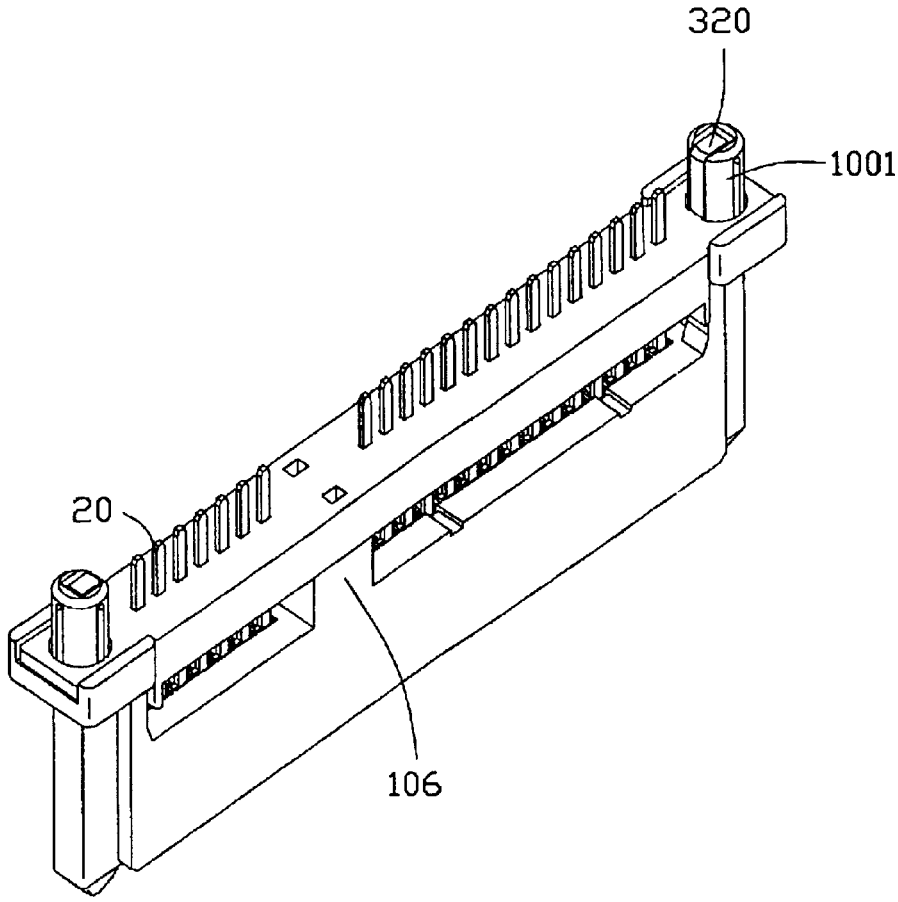
FIG. 4 is a bottom view of the electrical connector of FIG. 3.
Figure 6:
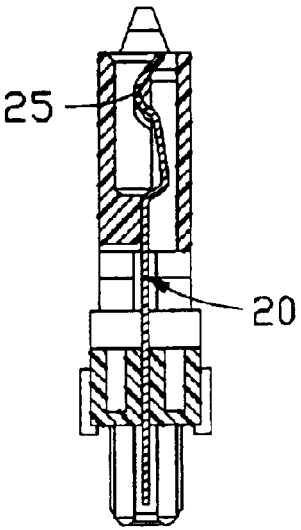
FIG. 6 is a cross-sectional view of the electrical connector of FIG. 3 taken along line 6—6 of FIG. 3.
Figure 5:
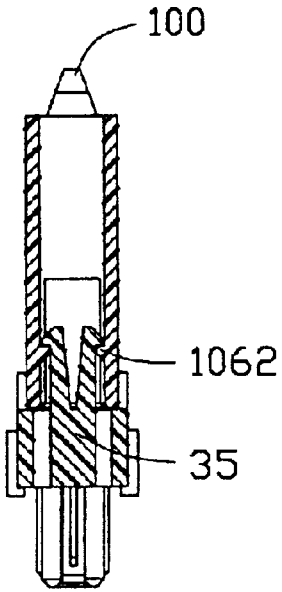
FIG. 5 is a cross-sectional view of the electrical connector of FIG. 3 taken along line 5—5 of FIG. 3.

Referring to the drawings and in particular to FIGS. 1 and 2, an electrical connector 1 for mating with a mating connector (not shown) according to the present invention comprises an elongate insulative housing 10, a plurality of conductive contacts 20, and a spacer 30, for organizing the contacts 20. The connector 1 has a mating portion 120 for mating with a mating connector (not shown) and a pair of flanges 130 at opposite ends of the mating portion for being mounted onto a printed circuit board (PCB, not shown).

The housing 10 has a mating surface 107 and an engaging surface 108. The housing 10 defines a plurality of passageways 104 from the engaging surface 108 to the mating surface 107, a first and a second cavities 101, 103 defined in the housing 10 from the engaging surface 108 to the mating surface 107. The first and second cavities 101, 103 have different dimension, and the first cavity receives a power segment of the mating connector (not shown) and the second cavity receives a signal segment of the mating connector (not shown). The first and second cavities 101, 103 each have anti-disorientation device. A substantially rectangular opening 102 is defined between the mating surface 107 and the engaging surface 108 and locates in a middle of the mating surface 107. The passageways 104 are in communication with the first and second cavities 101, 103. The housing 10 provides a pair of guiding posts 100 upwardly extending from the flanges 130 and outwardly protruding from opposite end walls 110 of the housing 10 in a transverse direction. The guiding post 100 has a sharp section upwardly extending beyond the mating surface 107 of the housing 10 for guidance of the connector to mate with the mating connector and a lower portion 1001 for mounting into the PCB. Each guiding post 100 has a plurality of rib portions 1003 formed on outer surface of the lower portion 1001. A receiving space 1000 is defined in each guiding post 100. A block 106 projects downwardly from a middle of the engaging surface 108 of the housing 10 and defines a receiving cavity 1060 therein. The receiving cavity 1060 is in communicating with the opening 102. The block 106 has a pair of engaging portions 1062 formed on inner walls thereof.

Figure 7:
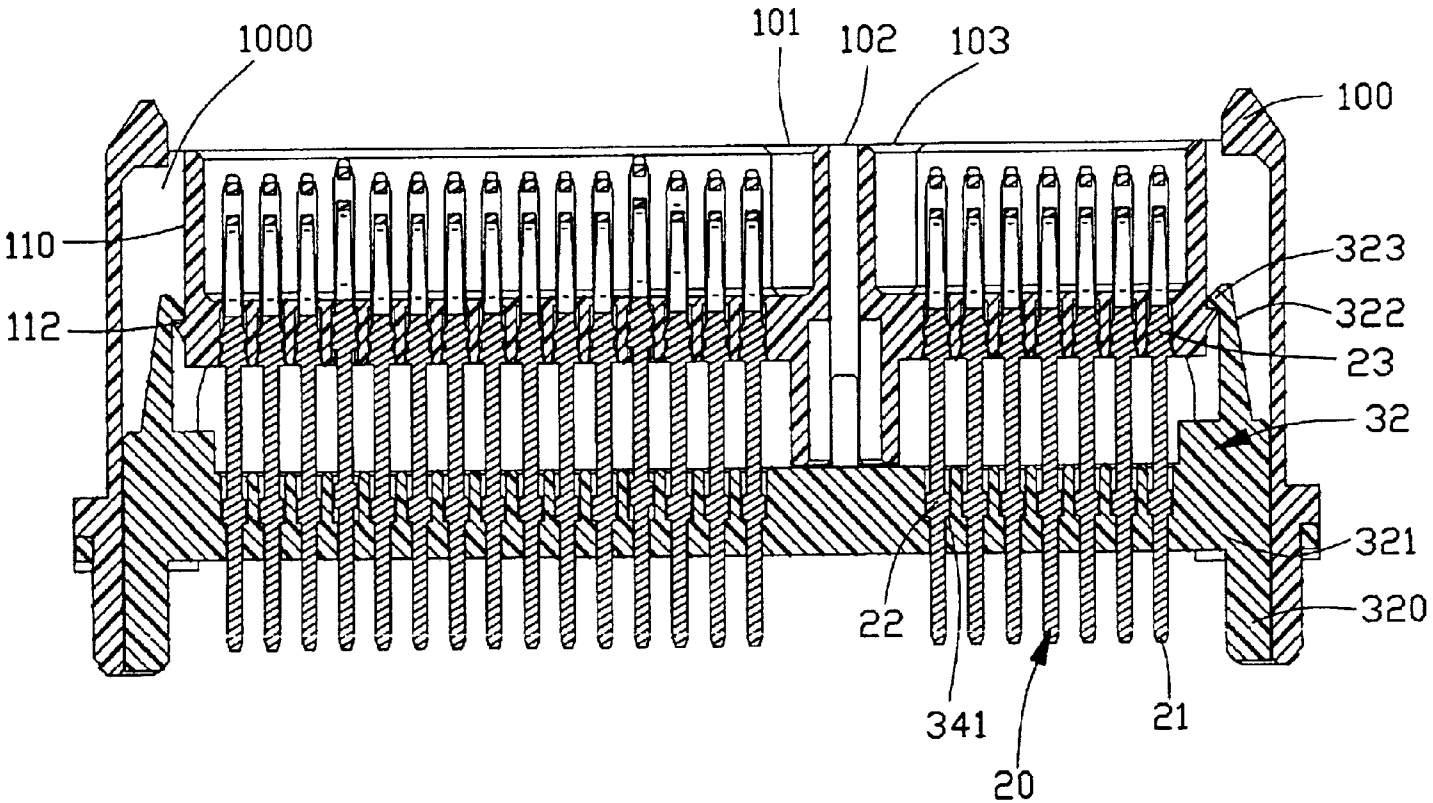
FIG. 7 is a cross-sectional view of the electrical connector of FIG. 3 taken along line 7—7 of FIG. 3.

Referring to FIG. 7, a pair of step portions 112 is respectively formed on opposite end walls 110 of the housing 10. Each flange 130 has a larger surface area adapted to face the PCB and defines a cutout 131 in a bottom face thereof.

The contact 20 extends elongately and each has a middle portion 24, a first retention portion 23 extending upwardly from an upper end of the middle portion 24, a second retention portion 22 extending downwardly from a low end of the middle portion 24, a mating portion 25 extending upwardly from the second retention portion 22, and a solder portion 21 extending downwardly from the second retention portion 22 for being soldered onto the print circuit board. The first retention portion 23 has a pair of barbs formed opposite sides thereof, and the second retention portion 22 has a pair of protrusions 222 formed opposite sides thereof.

The independent spacer 30 comprises a base 31, and a pair of hooks 32 integrally formed on opposite ends of the base 31. The base 31 defines a row of channels 34 for allowing the corresponding contacts 20 extending therethrough. The base 31 comprises a pair of mounting plates 36 projecting outwardly from opposite ends thereof, a pair of walls 310 projects upwardly from opposite ends thereof and an auxiliary hook 35 projecting upwardly from a middle of a top face thereof related to the block 106. The auxiliary hook 35 has a pair of hooks (not labeled) at a free end thereof. The hook 32 of the spacer 30 comprises a base portion 321 projecting outwardly from opposed walls 310 of the base 31, a substantial rectangle tail portion 320 extending downwardly from a lower portion of the base portion 321, and a locking portion 322 projecting from an upper end of the base portion 321. The locking portion 322 has a barb 323 at a free end thereof. The mounting plate 36 of the spacer 30 defines a circular hole 33 and the tail portion 320 of the hook 32 extends downwardly therethrough. Each channel 34 has a pair of step sections 341 located on inner walls thereof. The channel 34 is shaped substantially "T" by the step sections 341.

In assembly, referring particularly to FIGS. 3–7, the contacts 20 are firstly inserted into the passageways 104 of the housing with barbs of the first retention portion 23 engaging with inner walls of the passageways 104. When the contact 20 are received in the passageways 104, the mating portion 25 is exposed in the first cavity 101 or the second cavity 103. When the spacer 30 is assembled to the housing 10 under the engaging face 108 of the housing 10, the lower portions 1001 of the guiding posts 100 align with the holes 33 of the spacer, and the contacts 20 align with the channels 34 of the spacer 30. The solder portions 21 of the contacts 20 are inserted into the channels 34 until the protrusions 222 of the second retention portions 22 abut against the step sections 341, the lower portions 1001 are inserted into the holes 33 and extend beyond a bottom face of the spacer 30. When the locking portions 322 of the hooks 32 engages with the step portions 112 of the housing 10 in a longitudinal direction of the housing 10, the tail portion 320 is fully received in the receiving space 1000, the auxiliary hook 35 is received in the cavity 1060 of the lock block 106 and the hooks of the auxiliary hook 35 are engaged with the engaging portions 1062 in a traverse direction of the housing 10. Therefore, the mounting plates 36 of the spacer 30 are fully received in the cutouts 131 of the flanges 130 with the walls 310 abutting against inner sides of the end walls 110. Thereby, the housing 10 and the spacer 30 are firmly secured together with each channel 34 aligning with the corresponding passageway 104 in a line.

When the connector 1 is mounted onto the PCB (not shown) with the mounting plates 36 of the spacer 30 abutting against a top surface of the PCB, the rib portions 1003 of the guiding posts 100 are engaging with inner wall of a hole defined in the print circuit board to provide the connector with an excellent fixation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a first housing defining a first and a second cavities, a plurality of passageways communicating with the first and the second cavities and arranged in a line;

a plurality of contacts received in the passageways of the first housing, each contact including a solder portion extending away from the first housing;

a second housing attached to the first housing and defining a plurality of channels through which the solder portions of the contacts extend, each channel being vertically aligned with a corresponding passageway.

2. The electrical connector as claimed in claim 1, wherein the first and the second cavities have different dimensions, the first cavity receiving a power segment of a mating connector and the second cavity receiving a signal segment of the mating connector.

3. The electrical connector as claimed in claim 1, wherein the first and second cavities have anti-disorientation devices.

4. The electrical connector as claimed in claim 1, wherein the first housing has guiding posts extending from end walls of the first housing.

5. An electrical connector, comprising:

a first housing defining a plurality of passageways and a pair of guiding posts extending from end walls thereof;

a plurality of contacts received in the passageways, each contact including a solder portion extending away from the first housing;

a second housing attached to the first housing and defining a plurality of channels through which the solder portions of the contacts extend; and interengaging means arranged between the first and second housings and comprising a receiving space defined in the guiding post of the first housing and a hook formed on the second housing, the hook being securely attached in the receiving space.

6. The electrical connector as claimed in claim 5, wherein the hook projects upwardly from one of opposite ends of the second housing.

7. The electrical connector as claimed in claim 5, wherein the hook further includes a tail portion jointly formed with a lower portion of the guiding post to form a mounting post adapted to be received in a hole of a print circuit board.

8. The electrical connector as claimed in claim 7, wherein a plurality of rib portions is formed on outer surface of the guiding post for engaging with inner wall of the hole defined in the print circuit board.

9. The electrical connector as claimed in claim 7, wherein the second housing comprises a base and a pair of mounting plates projecting sidewardly from opposite ends thereof and being adapted to face the print circuit board.

10. The electrical connector as claimed in claim 9, wherein a through bole is defined in the mounting plate for allowing the tail portion of the hook and the lower portion of the guiding post to extend through.

11. The electrical connector as claimed in claim 7, wherein the lower portion of the guiding post defines a groove for receiving the tail portion of the hook.

12. The electrical connector as claimed in claim 9, wherein the guiding post further forms a flange defining a cutout in a bottom face thereof.

13. The electrical connector as claimed in claim 12, wherein the flange is located around the lower portion of the guiding post and has a larger surface area adapted to face the print circuit board.

14. The electrical connector as claimed in claim 13, wherein the cutout of the flange is adapted for receiving the mounting plate of the second housing.

15. The electrical connector as claimed in claim 5, wherein the interengaging means further includes a block extending from a middle portion of the first housing and an auxiliary hook on the second housing to be securely received in a receptacle of the block.

16. The electrical connector as claimed in claim 5, wherein each contact comprises a retention portion connected a mating portion with the solder portion.

17. The electrical connector as claimed in claim 16, wherein the retention portion of the contact comprises a first retention portion and a second retention portion, the first retention portion having barbs formed opposite sides for engaging with inner walls of the passageway of the first housing.

18. The electrical connector as claimed in claim 17, wherein the second retention portion has protrusions formed on opposite sides thereof, a pair of opposed step sections are defined on inner walls of the channel, the step sections stop the protrusions from moving downwardly.

19. An electrical connector comprising:

an insulative housing;

a plurality of contacts disposed in the housing;

a spacer attached to the housing and aligning solder tails of the contacts;

a pair of hollow guiding posts fanned at two opposite ends of the housing; and a pair of locking hooks formed at two opposite ends of the spacer and protectively extending into and hidden within the corresponding hollow posts and further latched with the housing.

* * * * *